US011079704B2

(12) United States Patent
Takahashi

(10) Patent No.: US 11,079,704 B2
(45) Date of Patent: Aug. 3, 2021

(54) IMAGE FORMING APPARATUS WITH ROTATING GUIDE MEMBER THAT GUIDES SHEET

(71) Applicant: CANON KABUSHIKI KAISHA, Tokyo (JP)

(72) Inventor: Hiroyuki Takahashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/783,367

(22) Filed: Feb. 6, 2020

(65) Prior Publication Data

US 2020/0264542 A1 Aug. 20, 2020

(30) Foreign Application Priority Data

Feb. 18, 2019 (JP) ..... JP2019-026455

(51) Int. Cl.
*G03G 15/00* (2006.01)
*G03G 15/20* (2006.01)
*G03G 15/16* (2006.01)

(52) U.S. Cl.
CPC ..... *G03G 15/2028* (2013.01); *G03G 15/5029* (2013.01); *G03G 15/657* (2013.01); *G03G 15/6573* (2013.01); *G03G 15/1675* (2013.01); *G03G 15/50* (2013.01)

(58) Field of Classification Search
CPC ..... G03G 15/6573; G03G 15/5029
See application file for complete search history.

(56) References Cited

U.S. PATENT DOCUMENTS 5,280,308 A 1/1994 Takahashi et al.
6,026,272 A 2/2000 Kusaka et al.
6,671,472 B2 12/2003 Shimizu et al.
9,150,038 B2 * 10/2015 Hashimoto ..... B41J 13/0036
2009/0267291 A1 * 10/2009 Tabata ..... G03G 15/5029 271/225
2020/0131802 A1 4/2020 Hwang

FOREIGN PATENT DOCUMENTS

JP 2006-326954 A 12/2006
JP 2016-000655 A 1/2016

* cited by examiner

*Primary Examiner* — Arlene Heredia
(74) *Attorney, Agent, or Firm* — Venable LLP

(57) ABSTRACT

An image forming apparatus includes: a first conveying member that nips and conveys a sheet; a guide member rotatable between a first guiding position where the guide member guides a sheet that is conveyed by the first conveying member toward a first direction and a second guiding position where the guide member guides the sheet toward a second direction that is different from the first direction; a second conveying member that conveys a sheet that has been guided toward the first direction; a third conveying member that conveys a sheet that has been guided toward the second direction; a driver that drives the guide member; an acquiring portion configured to acquiring a basis weight of a sheet; and a controller that controls the driver such as to change torque for driving the guide member based on a basis weight of a sheet acquired by the acquiring portion.

17 Claims, 11 Drawing Sheets

*FIG. 10*

| PAPER TYPE SETTINGS | SWITCHING SPEED | CURRENT SETTINGS | TORQUE MARGIN | CRASH MARGIN |
|---|---|---|---|---|
| PLAIN PAPER | High | Mid | ◎ | ◎ |
| THICK PAPER | Low | Mid | ◎ | ○ |
| VERY THICK PAPER | Low | High | ◎ | ○ |

FIG. 11

| | MODE | IMAGE QUALITY PRIORITIZED | | | | | PRODUCTIVITY PRIORITIZED | | | | |
|---|---|---|---|---|---|---|---|---|---|---|---|
| | IMAGE FORMING SPEED | CONSTANT SPEED / MEDIUM SPEED / LOW SPEED | | | | | CONSTANT SPEED / MEDIUM SPEED | | | | |
| PAPER TYPE SETTINGS | | INTER-SHEET SPACE WHEN PASSING THROUGH FLP PORTION | SWITCHING SPEED | CURRENT SETTINGS | TORQUE MARGIN | CRASH MARGIN | INTER-SHEET SPACE WHEN PASSING THROUGH FLP PORTION | SWITCHING SPEED | CURRENT SETTINGS | TORQUE MARGIN | CRASH MARGIN |
| PLAIN PAPER | INTER-SHEET DISTANCE | Mid | Low | Mid | ◎ | ◎ | Mid | High | Mid | ◎ | ◎ |
| | INTER-SHEET INTERVAL | Mid | | | | | Mid | | | | |
| THICK PAPER | INTER-SHEET DISTANCE | Mid | Mid | Mid | ◎ | ◎ | Short | Low | Mid | ◎ | ○ |
| | INTER-SHEET INTERVAL | Long | | | | | Short | | | | |
| VERY THICK PAPER | INTER-SHEET DISTANCE | Mid | Mid | High | ◎ | ◎ | Short | Low | High | ◎ | ○ |
| | INTER-SHEET INTERVAL | Long | | | | | Short | | | | |

IMAGE FORMING APPARATUS WITH ROTATING GUIDE MEMBER THAT GUIDES SHEET

BACKGROUND OF THE INVENTION

Field of the Invention

The present invention relates to an image forming apparatus that forms an image on a sheet.

Description of the Related Art

In an image forming apparatus such as a printer, typically, an image forming portion includes an image bearing member that carries a toner image, a transfer portion that transfers the toner image carried on the image bearing member to a sheet, and a fixing portion that fixes the transferred toner image on the sheet. The image forming apparatus also includes a sheet conveying apparatus for discharging the sheet on which the toner image has been formed by the image forming portion, or for inverting such sheet to be conveyed back to the image forming portion, or for discharging the sheet after inverting it for page alignment.

Such a sheet conveying apparatus includes a sheet discharge path for discharging the sheet, a reconveying path that diverges from the sheet discharge path for conveying the sheet back to the image forming portion, and an inversion conveying path that diverges from the reconveying path for inverting and discharging the sheet for page alignment. The sheet conveying apparatus also includes an inversion mechanism and a guide member rotatably provided to a branching portion between the sheet discharge path and the reconveying path.

When conveying the sheet back to the image forming portion, for example, or when discharging the sheet after inverting it, the guide member is rotated to direct the sheet to the reconveying path, after which the sheet is inverted by the inversion mechanism to be directed to the reconveying path or inversion conveying path. There is provided a rotation space in the branching portion between the sheet discharge path and the reconveying path to allow the guide member to rotate.

In an existing image forming apparatus, when sheets are conveyed in succession to form images on both sides of the sheets, a sheet which an image is to be formed on one side of, and a sheet which an image is to be formed on the other side of after having had an image formed on one side thereof, are conveyed alternately (see Japanese Patent Laid-Open No. 2016-655). Therefore, the switching of the guide member mentioned above is controlled such that a sheet having images formed on both sides is guided to the sheet discharge path, while a sheet which an image is to be formed on the other side of after having had an image formed on one side thereof is guided to the reconveying path.

In another image forming apparatus that has a flapper for switching a discharge port between a horizontal direction and a path for making a U-turn in a vertical direction, the conveying speed is increased when image recording is finished and the sheet is discharged in the horizontal direction (see Japanese Patent Laid-Open No. 2006-326954).

In existing image forming apparatuses, there is provided a sufficient space between the rear end of a preceding sheet and the distal end of a succeeding sheet that are conveyed in succession (hereinafter also referred to as "inter-sheet space"). Therefore the switching between the sheet discharge path and the reconveying path by the guide member could be performed with the same control scheme irrespective of the type of sheet or the setting of priority mode to achieve certain productivity of sheets per unit time.

To increase productivity of sheets per unit time, however, of existing image forming apparatuses, without changing the image forming speed at the image forming portion, it is necessary to make the space between sheets conveyed in succession narrower. If the space between sheets is to be made narrower for improving productivity, it is necessary to perform the switching of the guide member before a preceding sheet passes through the guide member, in order to switch the guide member before the distal end of a succeeding sheet reaches the guide member. Namely, it is necessary to perform the switching by rotating the guide member in a condition where the preceding sheet is still in contact with the guide member.

When the preceding sheet in contact with the guide member is a type of sheet having a large basis weight as compared to plain paper, such as thick paper, the guide member with this sheet of a large basis weight making contact therewith will require more force to be switched over. However, to make available an extra amount of force for switching the guide member regardless of the basis weight of the sheet, an expensive motor would be necessary, for example, as the driver that drives the guide member.

SUMMARY OF THE INVENTION

Accordingly, the present invention aims to improve the productivity per unit time of sheets with a large basis weight at low cost.

To achieve the aim noted above, an image forming apparatus according to the present invention includes: a first conveying member that nips and conveys a sheet on which an image has been formed; a guide member rotatable between a first guiding position where the guide member guides a sheet that is conveyed by the first conveying member toward a first direction and a second guiding position where the guide member guides the sheet toward a second direction that is different from the first direction; a second conveying member that conveys a sheet that has been guided toward the first direction by the guide member; a third conveying member that conveys a sheet that has been guided toward the second direction by the guide member; a driver that drives the guide member; an acquiring portion configured to acquire a basis weight of a sheet; and a controller that controls the driver such as to change torque for driving the guide member based on a basis weight of a sheet acquired by the acquiring portion.

Further features of the present invention will become apparent from the following description of exemplary embodiments with reference to the attached drawings.

BRIEF DESCRIPTION OF THE DRAWINGS

FIG. 10 is a table showing the relationship between control of the driver that drives the guide member and sheets.

FIG. 11 is a table showing the relationship between control of the driver that drives the guide member, sheets, and modes.

DESCRIPTION OF THE EMBODIMENTS

Hereinafter, embodiments of the present invention will be illustratively described in detail with reference to the drawings. The dimensions, materials, shapes, relative arrangements, and the like of the components described in the following embodiments are not intended to limit the scope of the present invention only to those unless otherwise specified.

Embodiment 1

An image forming apparatus according to this embodiment will now be described. In this embodiment, a color image forming apparatus that uses an electrophotographic system is shown as one example of image forming apparatus. More specifically, the illustrated image forming apparatus is of an intermediate transfer tandem system in which photosensitive members of four colors are aligned on an intermediate transfer belt.

(Image Forming Apparatus)

Figure 1:
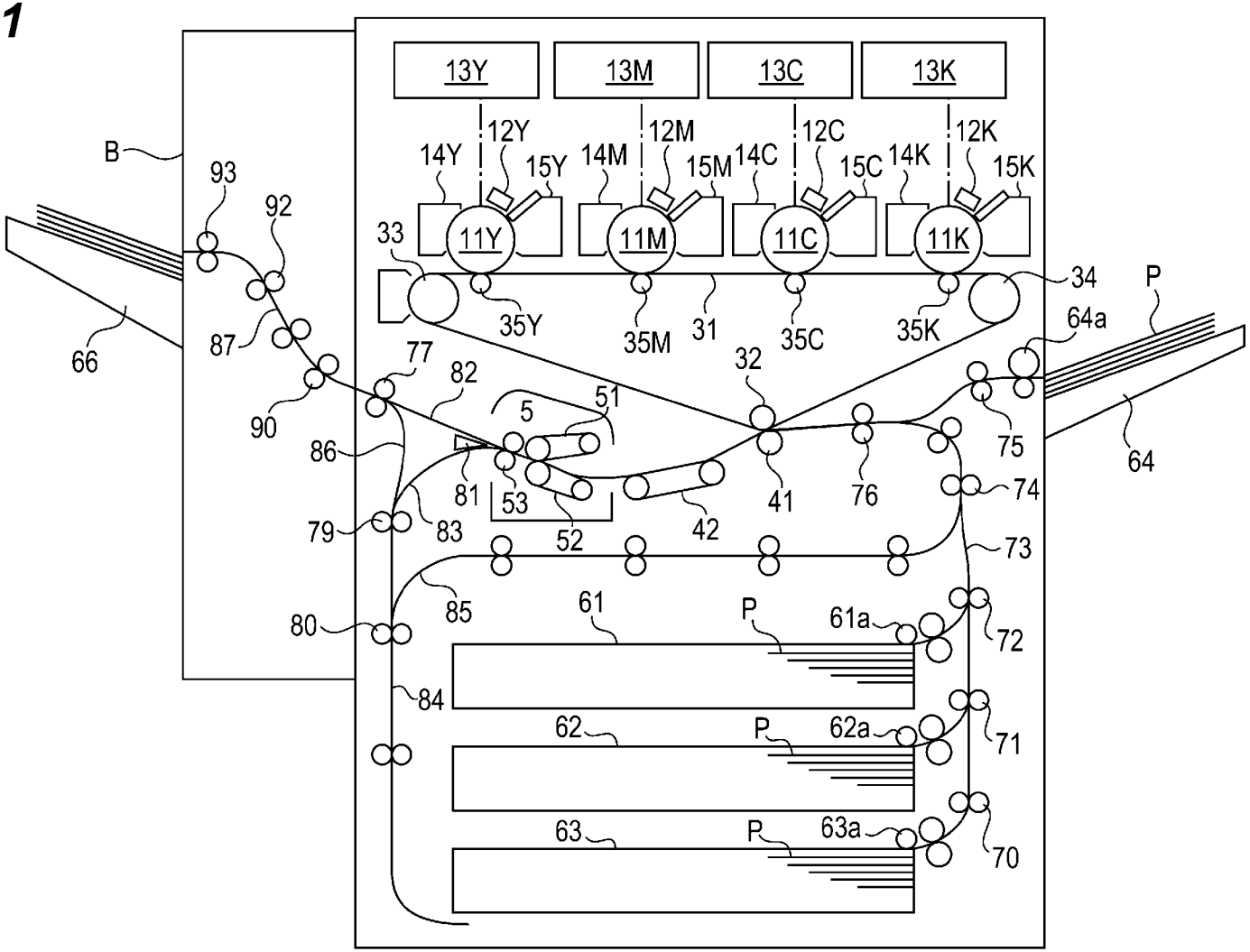
FIG. 1 is a schematic cross-sectional view of an image forming apparatus.

FIG. 1 shows a schematic cross-sectional view of the image forming apparatus according to this embodiment. The image forming apparatus according to this embodiment will be described with reference to FIG. 1.

Sheets P are stored in stack in sheet storage cases 61 to 64. The sheets P stored in the sheet storage cases 61 to 64 are selectively fed by sheet feeders 61*a* to 64*a* in sync with the image formation. A sheet P fed out by the sheet feeders 61*a* to 64*a* is passed through pairs of conveying rollers 70 to 75, a conveying path 73 and so on, and conveyed to a pair of registration rollers 76, which is a pre-transfer conveying portion. The pair of registration rollers 76 has a function of correcting skew feeding by adjusting the tip of the sheet P conveyed from the sheet storage cases 61 to 64 in which the sheet P is butted so as to form a loop. The pair of registration rollers 76 also has a function of conveying the sheet P to a secondary transfer portion at a predetermined timing in sync with the image formation on the sheet P, i.e., in registration with the toner image carried on an image bearing member. The sheet P is fed out to the secondary transfer portion at a desired timing after skew feeding has been corrected by the pair of registration rollers 76.

The secondary transfer portion is a nip portion formed by opposing secondary transfer inner roller 32 and secondary transfer outer roller 41 to transfer the toner image to the sheet P. The secondary transfer portion transfers the toner image formed on an intermediate transfer belt 31 that is an intermediate transfer member to the sheet P by applying a predetermined pressure and electrostatic load bias.

There now follows a description of an image forming process in which an image is conveyed to the secondary transfer portion at the same timing as the conveying process of the sheet P to the secondary transfer portion described above.

The image forming apparatus includes an image forming portion that forms an image on a sheet P. The image forming portion generally includes a photosensitive member 11 (11Y, 11M, 11C, 11K), a charging unit 12 (12Y, 12M, 12C, 12K), an exposure unit 13 (13Y, 13M, 13C, 13K), a developing unit 14 (14Y, 14M, 14C, 14K), a primary transfer unit 35 (35Y, 35M, 35C, 35K), and a photosensitive member cleaner 15 (15Y, 15M, 15C, 15K). The image forming portion further includes the image bearing member that carries a toner image, a transfer portion that transfers the toner image carried on the image bearing member to a sheet, and a fixing portion that fixes the transferred toner image on the sheet. Here, the image bearing member is the intermediate transfer belt 31, the transfer portion is the secondary transfer portion, and the fixing portion is a fixing unit 5.

The photosensitive member 11 is uniformly charged beforehand by the charging unit 12. The exposure unit 13 is driven based on transmitted signals of image information, and a latent image is formed on the charged photosensitive member 11. The electrostatic latent image formed on the photosensitive member 11 is made visible as a toner image on the photosensitive member 11 through toner development by the developing unit 14. The toner image formed on the photosensitive member 11 is then transferred onto the intermediate transfer belt 31 by the primary transfer unit 35 applying a predetermined pressure and electrostatic load bias. After the transfer, any residual toner left on the photosensitive member 11 after transfer is collected by the photosensitive member cleaner 15 to be used again for next image formation.

The image forming apparatus shown in FIG. 1 has four sets of the photosensitive member 11, charging unit 12, exposure unit 13, developing unit 14, primary transfer unit 35, and photosensitive member cleaner 15 described above for yellow (Y), magenta (M), cyan (C), and black (Bk). Not to mention, the number of colors is not limited to these four, and the order of the colors is not limited to this.

Next, the intermediate transfer belt 31 will be described. The intermediate transfer belt 31 as an intermediate transfer member is an image bearing member that carries a toner image transferred from each photosensitive member 11. The intermediate transfer belt 31 is passed over rollers such as a drive roller 33, a tension roller 34, a secondary transfer inner roller 32 and so on, and driven to convey images. The image forming processes for yellow (Y), magenta (M), cyan (C), and black (Bk) described above are performed in parallel and at such timing that images are superimposed on toner image(s) of upstream color(s) primarily transferred on the intermediate transfer belt 31. As a result, a full-color toner image is eventually formed on the intermediate transfer belt 31, which is then conveyed to the secondary transfer portion.

A full-color toner image is thus secondarily transferred to the sheet P in the secondary transfer portion through the conveying process of the sheet P and the image forming process each described above.

After that, the sheet P is conveyed to the fixing unit 5 by a suction conveying portion 42. The suction conveying portion 42 conveys the sheet P by air suction using a fan or the like. The fixing unit 5 fuses and fixes the toner image on the sheet P by applying a predetermined pressure by opposing belts 51 and 52 (or rollers) and a heating effect using a heat source such as a heater. The sheet P on which the image has been formed in this way is conveyed to a sheet discharge portion by a pair of conveying rollers 53 provided in the fixing unit 5.

The sheet P on which the image has been formed is conveyed to a discharge conveying path 82 after an image has been formed on one side in one-side image formation, or after an image has been formed also on the other side in double-sided image formation. The sheet P on which the image has been formed is conveyed to an inverting path 83 when it is to be inverted before being discharged in one-side image formation, or after an image has been formed on one side in double-sided image formation. The sheet P on which the image has been formed is guided to either one of the discharge conveying path 82 and inverting path 83 by switching the guiding position of the guide member 81. The guide member 81 switches its position using an actuator (driver) such as a motor or a solenoid.

The sheet P guided to the inverting path 83 is conveyed to a switchback path 84 by a pair of inverting rollers 79 capable of rotating in forward and reverse directions. The sheet P that has been conveyed to the switchback path 84 is conveyed to a post-inversion path 86 by switching the rotation direction of the pair of inverting rollers 79 between forward and reverse directions (switchback action). The sheet P that has been conveyed to the switchback path 84, in duplex conveyance, is conveyed by a pair of duplex inverting rollers 80 capable of rotating in forward and reverse directions. The front and back ends of the sheet are inverted by rotating the pair of duplex inverting rollers 80 in forward and reverse directions before the sheet is conveyed to a duplex conveying path 85.

In duplex conveyance, the sheet P that has been conveyed to the duplex conveying path 85 is rejoined at correct timing to the flow of a succeeding sheet that is conveyed from one of the sheet feeders 61*a* to 64*a* for image formation on the other side. Namely, when sheets are conveyed in succession to form images on both sides of the sheets, a sheet which an image is to be formed on one side of, and a sheet which an image is to be formed on the other side of after having had an image formed on one side thereof, are alternately fed. After rejoined, the sheet P is fed to the secondary transfer portion through the pair of registration rollers 76, similarly to when forming an image on one side of the sheet. The process of forming an image on the other side of the sheet P will not be described again since it is similar to the previously described process of forming an image on one side.

The sheet P that has passed through the fixing unit 5 goes through the discharge conveying path 82, or inverting path 83 and post-inversion path 86, after which it travels through the pair of discharge rollers 77 to a discharge path 87 and pairs of conveying rollers 90 to 93 inside a discharge buffer portion B, before being discharged into a discharge tray 66.

(Detailed Description of Configuration and Control of Guide Member)

The configuration and control of the peripheral parts of the guide member 81 in the image forming apparatus according to this embodiment will be described with reference to FIG. 2 and FIG. 3.

First, the configuration of the peripheral parts of the guide member 81 will be described with reference to FIG. 2. FIG. 2 is a schematic cross-sectional view of the vicinity of the guide member 81.

Figure 2:
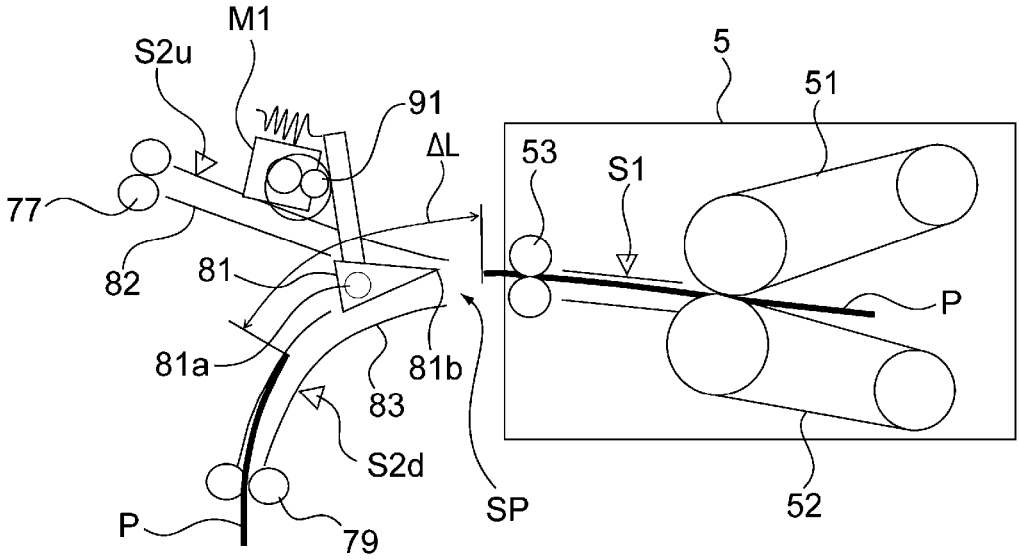
FIG. 2 is a schematic cross-sectional view of the vicinity of a guide member in the image forming apparatus.

As shown in FIG. 2, the fixing unit 5 in the image forming apparatus according to this embodiment includes belts 51 and 52 that apply heat and pressure to fix the image formed on the sheet P, and a pair of conveying rollers 53 that nips and conveys the sheet P that has passed through the belts 51 and 52. The pair of conveying rollers 53 is a first conveying member that nips and conveys the sheet P with an image formed thereon. While a pair of conveying rollers 53 provided inside the fixing unit 5 is shown as one example of the first conveying member, the conveying member is not limited to this. For example, the conveying member may be the belts 51 and 52 that make up the fixing unit 5, or may be other conveying members having other configurations that nip and convey sheets.

The guide member 81 can rotate between a discharge position that is a first guiding position where the guide member 81 guides a sheet P that is conveyed by the pair of conveying rollers 53 provided in the fixing unit 5 toward a first direction, and a draw-in position that is a second guiding position where the guide member 81 guides the sheet toward a second direction that is different from the first direction. Namely, the guide member 81 is rotated in an up and down direction around a shaft 81*a* as a pivot point by a drive motor M1 that is a driver capable of rotating in forward and reverse directions and a rotary portion 91 having a gear mechanism shown in FIG. 2 to move between the discharge position and the draw-in position. A pulsed motor is used as the drive motor M1 that drives the guide member 81.

As shown in FIG. 2, a post-fixation sensor S1 that detects a sheet P is disposed between the belts 51 and 52 and the pair of conveying rollers 53 in the fixing unit 5. A discharge sensor S2*u* that detects a sheet P that has been guided toward the first direction by the guide member 81 is disposed in the discharge conveying path 82. An inversion sensor S2*d* that detects a sheet P that has been guided toward the second direction that is different from the first direction by the guide member 81 is disposed in the inverting path 83. A pair of discharge rollers 77 that is a second conveying member for conveying the sheet P that has been guided toward the first direction by the guide member 81 is disposed downstream of the discharge sensor S2*u*. A pair of inverting rollers 79 that is a third conveying member for conveying the sheet P that has been guided toward the second direction that is different from the first direction by the guide member 81 is disposed downstream of the inversion sensor S2*d*.

Next, the control system of the image forming apparatus will be described with reference to FIG. 3. FIG. 3 is a block diagram of the control system of the image forming apparatus 1 according to this embodiment.

Figure 3:
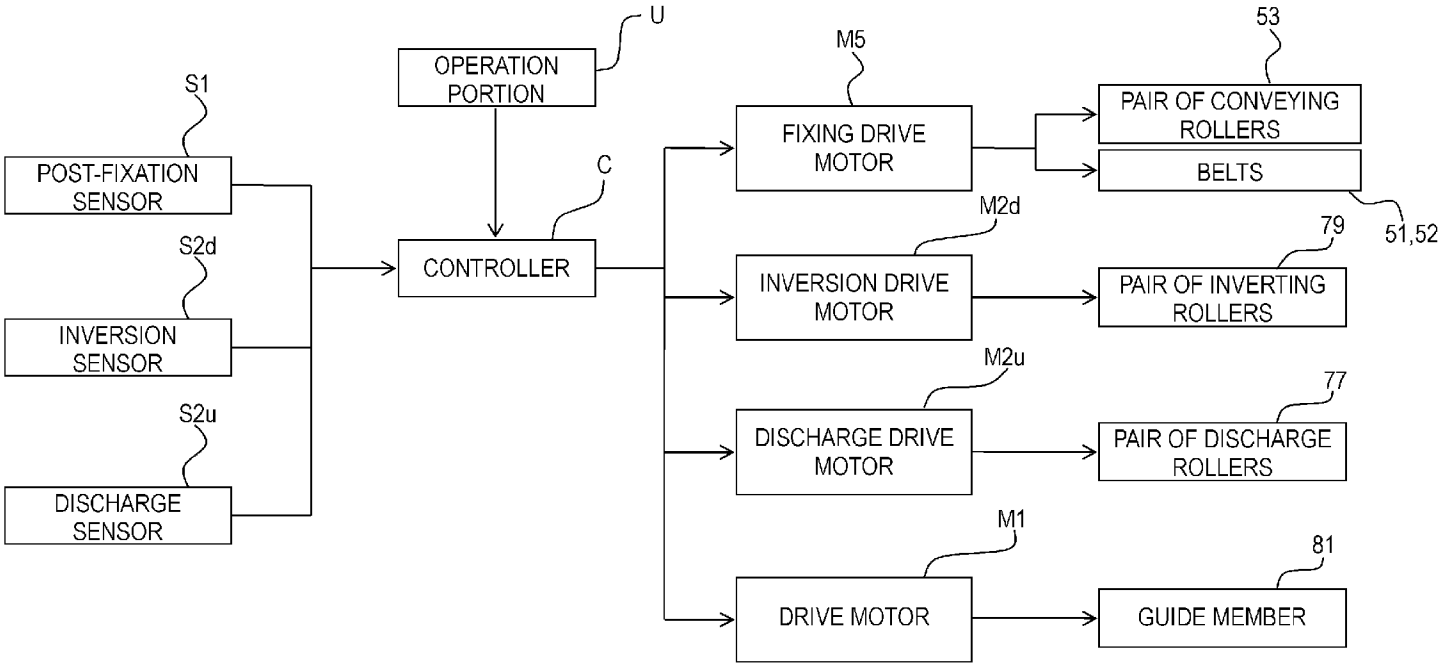
FIG. 3 is a block diagram of a control system in the image forming apparatus.

As shown in FIG. 3, a controller C executes overall control of the image forming apparatus. Signals from the post-fixation sensor S1, inversion sensor S2*d*, and discharge sensor S2*u* mentioned above, and settings information from an operation portion U are each input to the controller C. The controller C drives each motor and the like of the image forming apparatus in accordance with the input information from the operation portion U to form an image on a sheet while conveying the sheet. The controller C drives a fixing drive motor M5, a discharge drive motor M2*u*, and an inversion drive motor M2*d* in accordance with the timing at which the sheet P is detected by the post-fixation sensor S1, inversion sensor S2*d*, and discharge sensor S2*u*. The fixing drive motor M5 drives the belts 51 and 52 and the pair of conveying rollers 53 in the fixing unit 5. The discharge drive motor M2*u* drives the pair of discharge rollers 77. The inversion drive motor M2*d* drives the pair of inverting rollers 79.

The controller C drives the drive motor M1 in accordance with settings in the operation portion U to rotate the guide member 81. The operation portion U allows for setting of a basis weight of the sheet P. In other words, the operation portion U, as acquiring portion, acquires a basis weight of the sheet P. The controller C controls the drive motor M1 such as to change the torque for driving the guide member 81 based on a set basis weight of a sheet P.

Figure 4A:
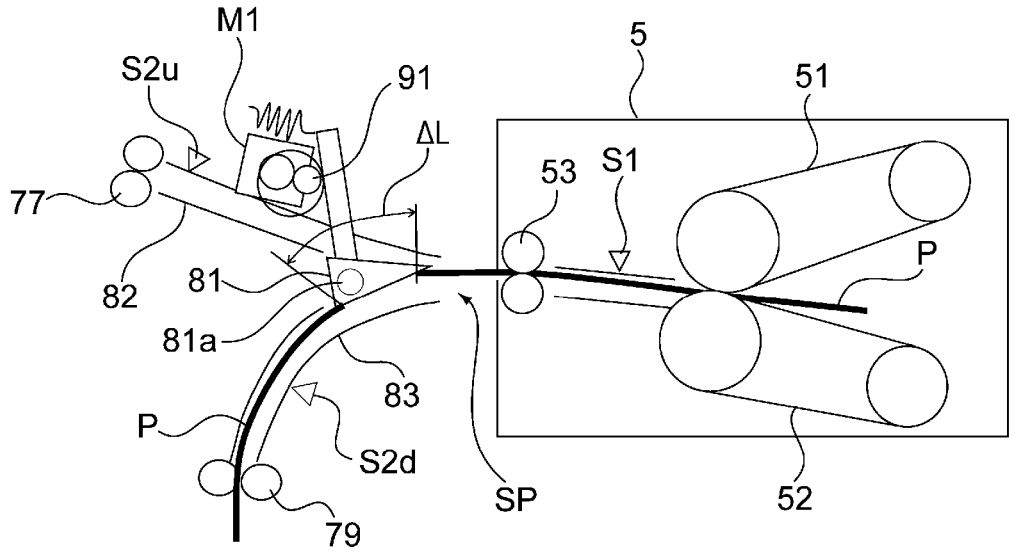
FIGS. 4A and 4B are schematic cross-sectional views illustrating an operation of the guide member.
Figure 5A:
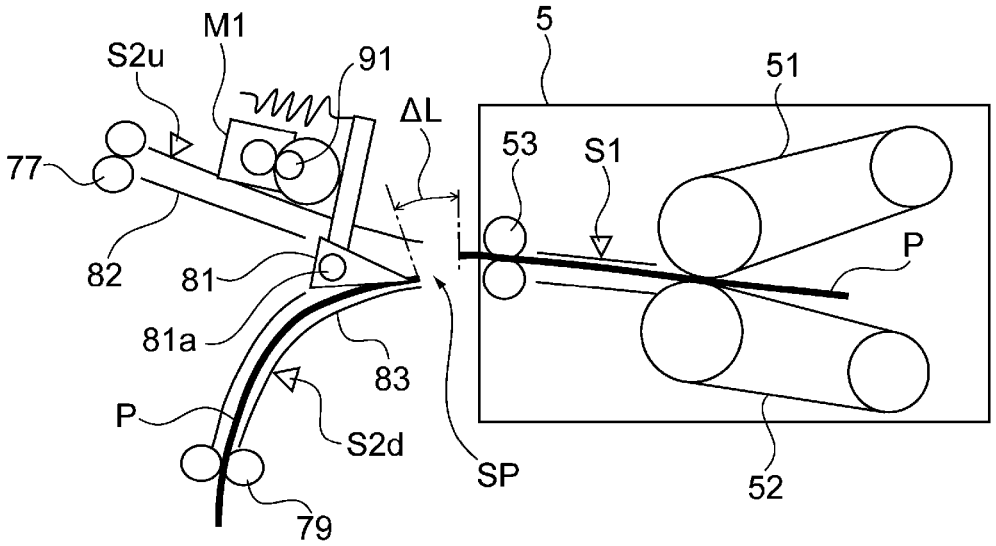
FIGS. 5A and 5B are schematic cross-sectional views illustrating an operation of the guide member.

For example, when a printer job is started by the operation portion U, the controller C drives the drive motor M1 to rotate so as to rotate the guide member 81 upward as shown in FIG. 4A to move the guide member 81 to the draw-in position (second guiding position). This causes the sheet P being conveyed by the pair of conveying rollers 53 to be guided toward the pair of inverting rollers 79 in the second direction by the guide member 81 in the draw-in position. When a face-up discharge mode is set by the operation portion U, the controller C drives the drive motor M1 to rotate so as to rotate the guide member 81 downward as shown in FIG. 5A to move the guide member 81 to the discharge position (first guiding position). This causes the sheet P being conveyed by the pair of conveying rollers 53 to be guided toward the pair of discharge rollers 77 in the first direction by the guide member 81 in the discharge position.

When a duplex conveyance mode is set by the operation portion U, the controller C drives the drive motor M1 to rotate so as to rotate the guide member 81 upward and downward as illustrated in the order of FIG. 4A, FIG. 4B, FIG. 5A, FIG. 5B, FIG. 6A, FIG. 6B, and FIG. 7. When the duplex conveyance mode is set, there may be a case where a sheet on which an image has been formed on one side and to which an image is going to be formed on the other side, and a sheet on which an image has been formed on one side and an image has been formed on the other side, too, alternately pass through the fixing unit 5. Here, the sheet on which an image has been formed on one side and to which an image is going to be formed on the other side shall be referred to as a one-side printed sheet, whereas the sheet on which an image has been formed on one side and an image has been formed on the other side, too, shall be referred to as a duplex printed sheet. When the one-side printed sheet and the duplex printed sheet pass through the fixing unit 5 in this order, the guide member 81 is rotated as illustrated in the order of FIG. 4A, FIG. 4B, FIG. 5A, FIG. 5B, FIG. 6A, FIG. 6B, and FIG. 7.

The controller C drives the drive motor M1 to rotate so as to rotate the guide member 81 upward as shown in FIG. 4A to move the guide member 81 to the draw-in position (second guiding position). This causes the one-side printed sheet being conveyed by the pair of conveying rollers 53 to be guided toward the pair of inverting rollers 79 in the second direction by the guide member 81 in the draw-in position.

There exists a rotation space SP between the fixing unit 5 and the pair of inverting rollers 79 as shown in FIG. 2 to allow the guide member 81 to rotate in the up and down direction. This rotation space SP has a size that allows the guide member 81 to rotate to predetermined angles so that the sheet can be reliably guided to the discharge conveying path 82 or the inverting path 83 by the guide member 81.

With the rotation space SP being this wide, when the conveying speed of the sheet P being conveyed in contact with the guide member 81 is slow, the sheet P may buckle within the conveying path. When sheet buckling occurs, the conveying efficiency of the pair of conveying rollers 53 is lowered, and as the sheet P continues to be conveyed, the pair of conveying rollers 53 may slip, causing paper jamming.

Figure 4B:
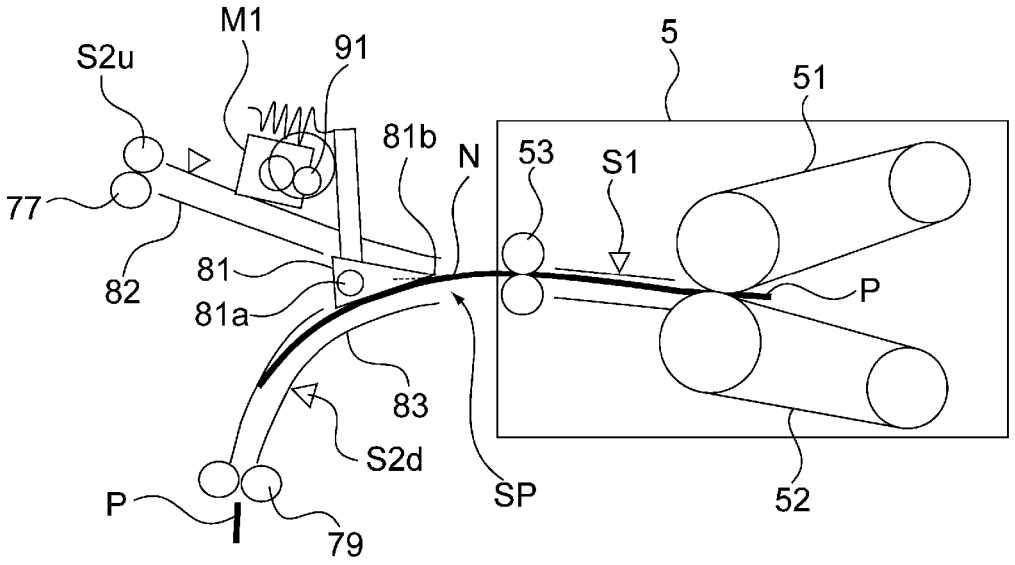

Therefore, after the tip of the one-side printed sheet being conveyed by the pair of conveying rollers 53 has reached the guide member 81 at the draw-in position, the controller C drives the drive motor M1 to rotate so as to rotate the guide member 81 to a fourth guiding position where, as shown in FIG. 4B, an upstream end 81*b* of the guide member 81 comes close to a tangential line N at a nip portion of the pair of conveying rollers 53. This causes the guide member 81 to move to a position where it reduces the rotation space SP that is provided for receiving the sheet P fed thereto. By moving the guide member 81 to the fourth guiding position (hereinafter referred to as loop preventing position) this way, the sheet being conveyed along the guide member 81 is pressed, and since the rotation space SP is narrowed, buckling of the sheet P can be prevented.

Figure 5B:
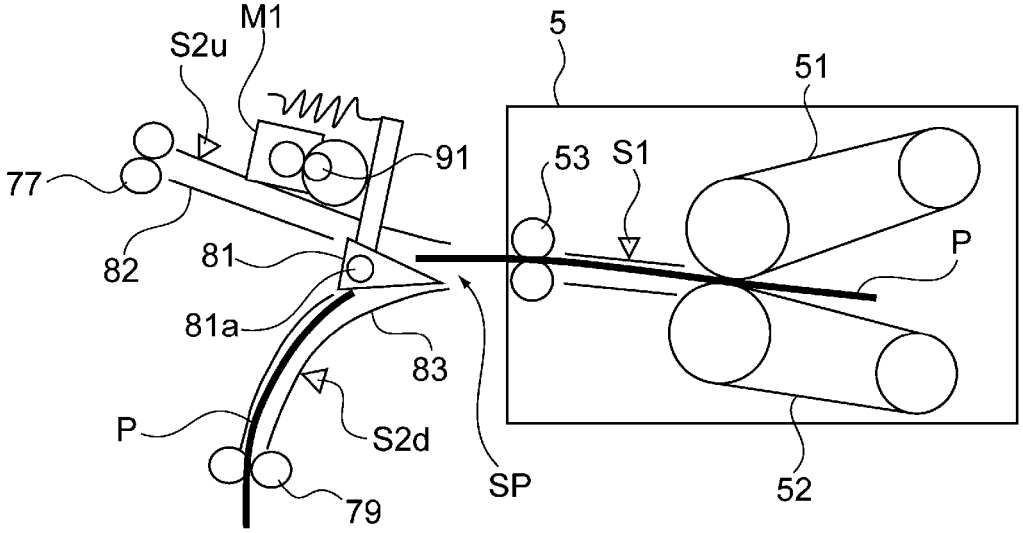
Figure 6A:
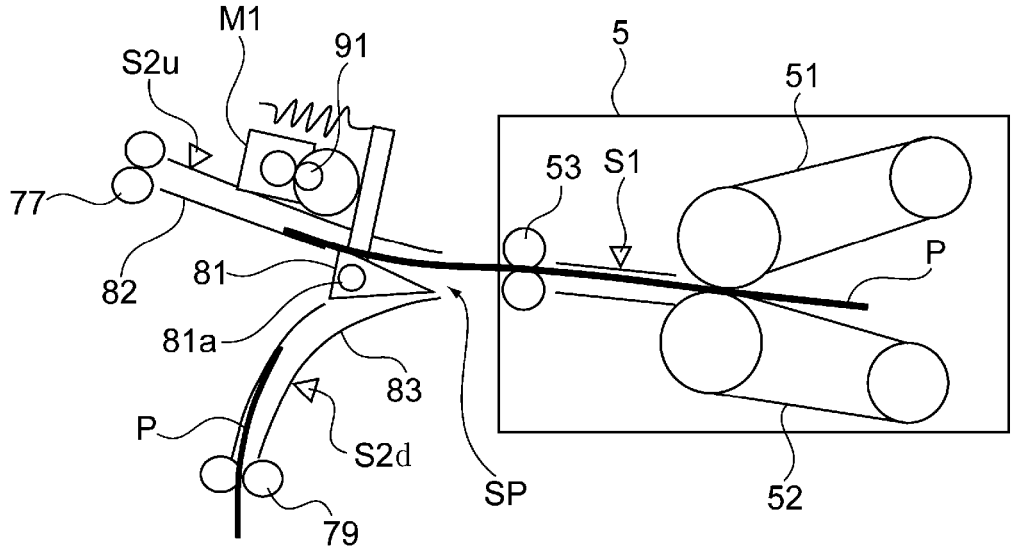
FIGS. 6A and 6B are schematic cross-sectional views illustrating an operation of the guide member.

Next, before the tip of the duplex printed sheet following the one-side printed sheet reaches the guide member 81, the controller C drives the drive motor M1 to rotate so as to rotate the guide member 81 downward as shown in FIG. 5A to move the guide member 81 to the discharge position (first guiding position). This causes the duplex printed sheet being conveyed by the pair of conveying rollers 53 to be guided toward the pair of discharge rollers 77 in the first direction by the guide member 81 in the discharge position as shown in FIG. 5B and FIG. 6A.

Figure 6B:
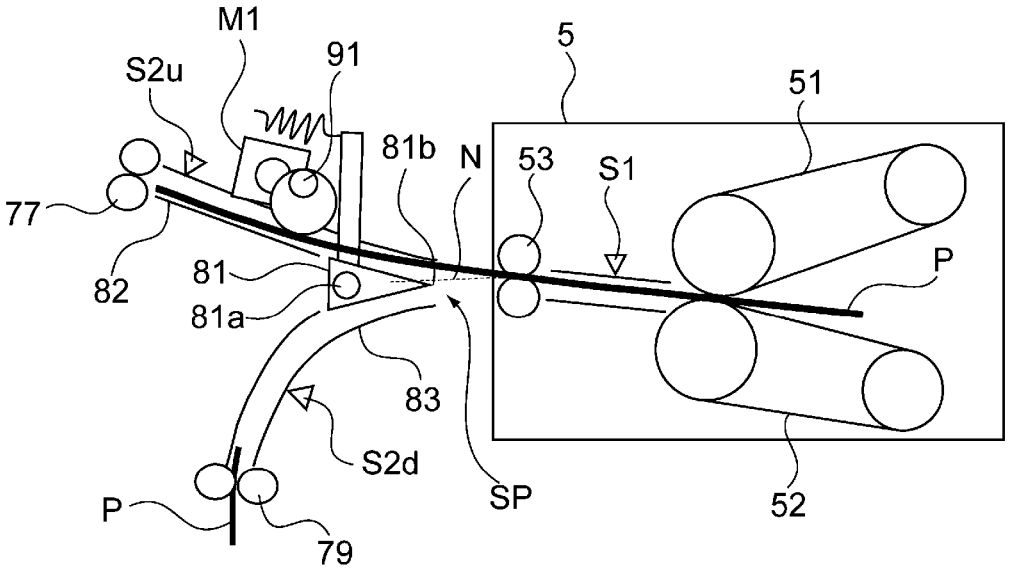

After the tip of the duplex printed sheet being conveyed by the pair of conveying rollers 53 has reached the guide member 81 at the discharge position, the controller C drives the drive motor M1 to rotate so as to rotate the guide member 81 to a third guiding position where, as shown in FIG. 6B, its upstream end 81*b* comes close to a tangential line N at the nip portion of the pair of conveying rollers 53. This causes the guide member 81 to move to a position where it reduces the rotation space SP that is provided for receiving the sheet P fed thereto. By moving the guide member 81 to the third guiding position (hereinafter referred to as loop preventing position) this way, the sheet being conveyed along the guide member 81 is lifted up, and since the rotation space SP is narrowed, buckling of the sheet P can be prevented.

Figure 7:
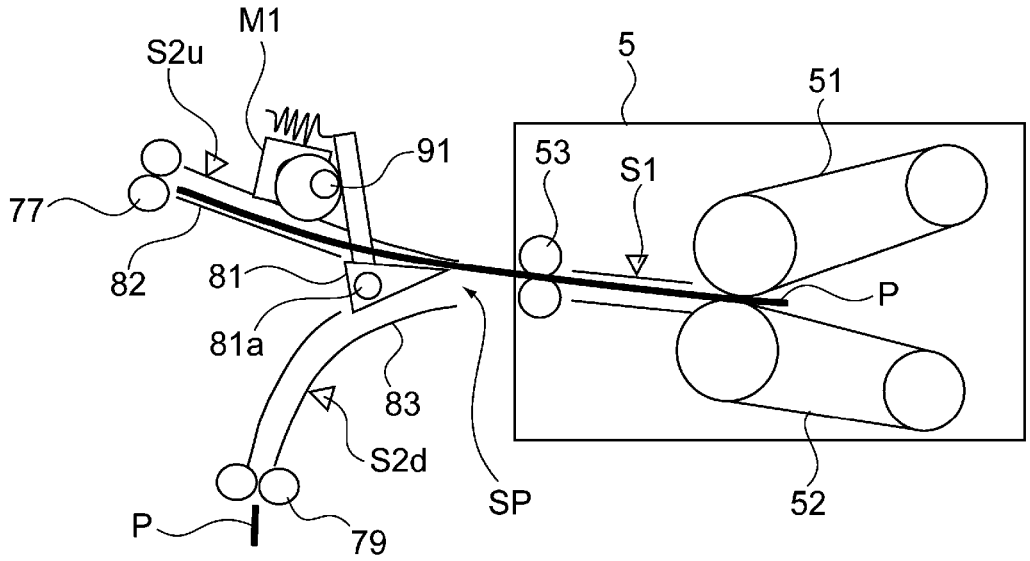
FIG. 7 is a schematic cross-sectional view illustrating an operation of the guide member.

After that, before the tip of the one-side printed sheet following the duplex printed sheet reaches the guide member 81, the controller C drives the drive motor M1 to rotate so as to rotate the guide member 81 upward as shown in FIG. 7 to move the guide member 81 again to the draw-in position (second guiding position).

When the duplex conveyance mode is set by the operation portion U, as mentioned above, the guide member 81 is repeatedly rotated upward and downward as illustrated in the order of FIG. 4A, FIG. 4B, FIG. 5A, FIG. 5B, FIG. 6A, FIG. 6B, and FIG. 7.

In this embodiment, the loop preventing position is the position where the upstream end (rotating end) 81*b* of the guide member 81 comes close to the tangential line (nip line) N at the nip portion of the pair of conveying rollers 53, as shown in FIG. 4B and FIG. 6B and described above. More specifically, the loop preventing position is the position where the upstream end (rotating end) 81*b* of the guide member 81 does not go past the tangential line (nip line) N. With the loop preventing position being thus set, the distal end (rotating end) of the guide member 81 is prevented from abutting the sheet P, which prevents the guide member 81 from inhibiting the conveyance of the sheet P by the pair of conveying rollers 53.

(Drive Control of Actuator in Accordance with Sheet Basis Weight)

The controller C (see FIG. 3) of the image forming apparatus according to this embodiment controls the drive of the drive motor M1 that is the driver (actuator) such as to change the torque for driving the guide member 81 in accordance with a basis weight of the sheet set by the operation portion U. This will be described in more detail below.

The user sets sheets of different sizes or basis weights as required in the sheet storage cases of the image forming apparatus according to the product the user wishes to output, and inputs the corresponding basis weight setting of the sheet using the operation portion U. When outputting products, the image forming apparatus allows for a selection of a priority mode from the operation portion U to determine whether priority should be given to image quality or to productivity.

When the sheet to be used is thick paper or very thick paper having a large basis weight as compared to plain paper, more force is required for switching the guide member that this sheet of a large basis weight makes contact with. However, to make available an extra amount of force for switching the guide member regardless of the basis weight of the sheet, an expensive motor would be necessary, for example, as the driver that drives the guide member.

To improve the productivity of sheets per unit time (product) of the image forming apparatus without altering a component to such an expensive member, it is necessary to reduce the space ΔL (see FIG. 2) between the rear end of a preceding sheet and the distal end of a succeeding sheet that are conveyed in succession.

When the duplex conveyance mode is set, the sheet cannot pick up speed until it passes through the nip portion of the belts 51 and 52 inside the fixing unit 5. Namely, the image forming speed of the image forming portion cannot be increased. When the space ΔL between sheets is reduced to improve the productivity, it is necessary to switch the guiding position of the guide member 81 before a succeeding sheet reaches the guide member 81 even as the preceding sheet is still in contact with and being guided by the guide member 81, as shown in FIG. 4A. Therefore, the guide member 81 is to be rotated to perform the switching operation with the rear end of the preceding sheet in contact with the guide member 81 (see FIG. 5A).

When passing a sheet of very thick paper having a large basis weight (e.g., 350 gsm paper), the guide member 81 receives a reaction force due to the rigidity of the very thick paper. When very thick paper is conveyed to the inverting path 83, for example, the guide member 81 receives a greater reaction force than the reaction force it receives when conveying plain paper (e.g., 81 gsm paper).

Therefore, when the sheet to be used is thick paper or very thick paper having a larger basis weight than plain paper, the drive motor M1 that drives the guide member 81 requires a driving force that overcomes the rigidity of the very thick paper so as to drive the guide member 81 stably.

Figure 8:
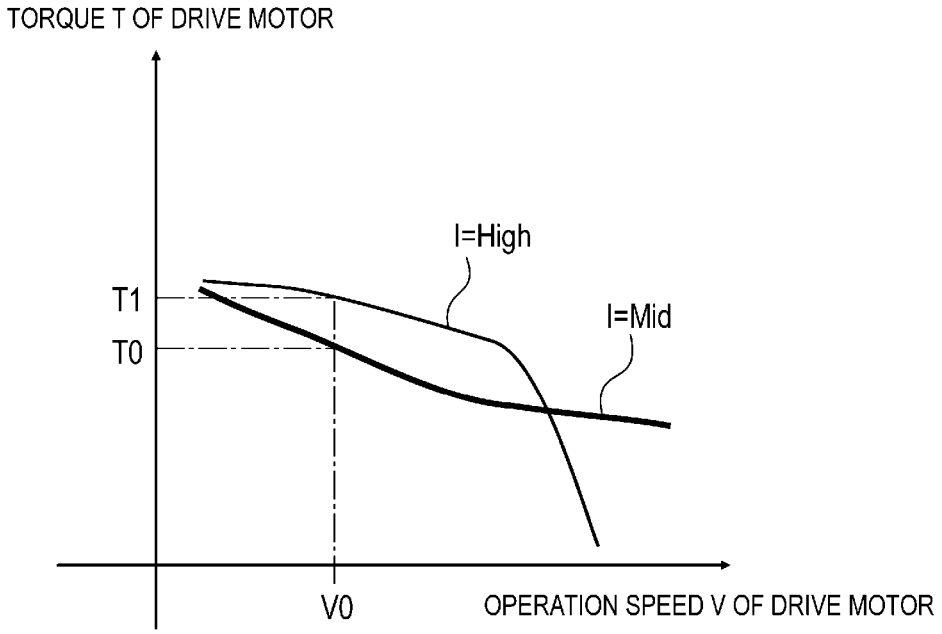
FIG. 8 is a diagram illustrating the relationship between speed and torque of a driver that drives the guide member.

FIG. 8 is a diagram illustrating the relationship between torque T and operation speed V of the drive motor M1 that drives the guide member 81. As shown in FIG. 8, when the current I to the drive motor M1 is Mid (e.g., 0.5 A), the torque for the operation speed V0 (e.g., 2.5 rps) of the drive motor M1 is T0 (e.g., 30 mNm). On the other hand, when the current I to the drive motor M1 is High that is larger than Mid mentioned above (e.g., 0.7 A), the torque for the operation speed V0 (e.g., 2.5 rps) of the drive motor M1 is T1 that is larger than T0 mentioned above (e.g., 40 mNm).

This way, by changing the current I to the drive motor M1, the torque T for driving the guide member 81 can be changed when the operation speed V of the drive motor M1 that drives the guide member 81 is the same operation speed V0.

When the current I to the drive motor M1 is High, too much an extra in the torque T would increase vibration and could lead to drive failures due to stalling of the drive motor M1. Therefore, when setting the current I to the drive motor M1 to High, i.e., when increasing the current I, the drive motor M1 needs to be given a certain load.

In this embodiment, the current I to the drive motor M1 is changed so as to change the torque for rotating the guide member 81 to a torque in accordance with the set basis weight of the sheet in a condition where the sheet P has reached the guide member 81.

In this embodiment, the controller C changes the rotation speed of the guide member 81 rotated by the drive motor M1 or the current I to the drive motor M1 so as to change the torque for driving the guide member 81 in accordance with the basis weight of the sheet P set by the operation portion U. More specifically, the controller C reduces the rotation speed of the guide member 81 rotated by the drive motor M1 (hereinafter, "switching speed"), or increases the current I to the drive motor, so as to increase the torque for driving the guide member 81, when the set basis weight of the sheet P is greater than a predetermined value.

Figure 9:
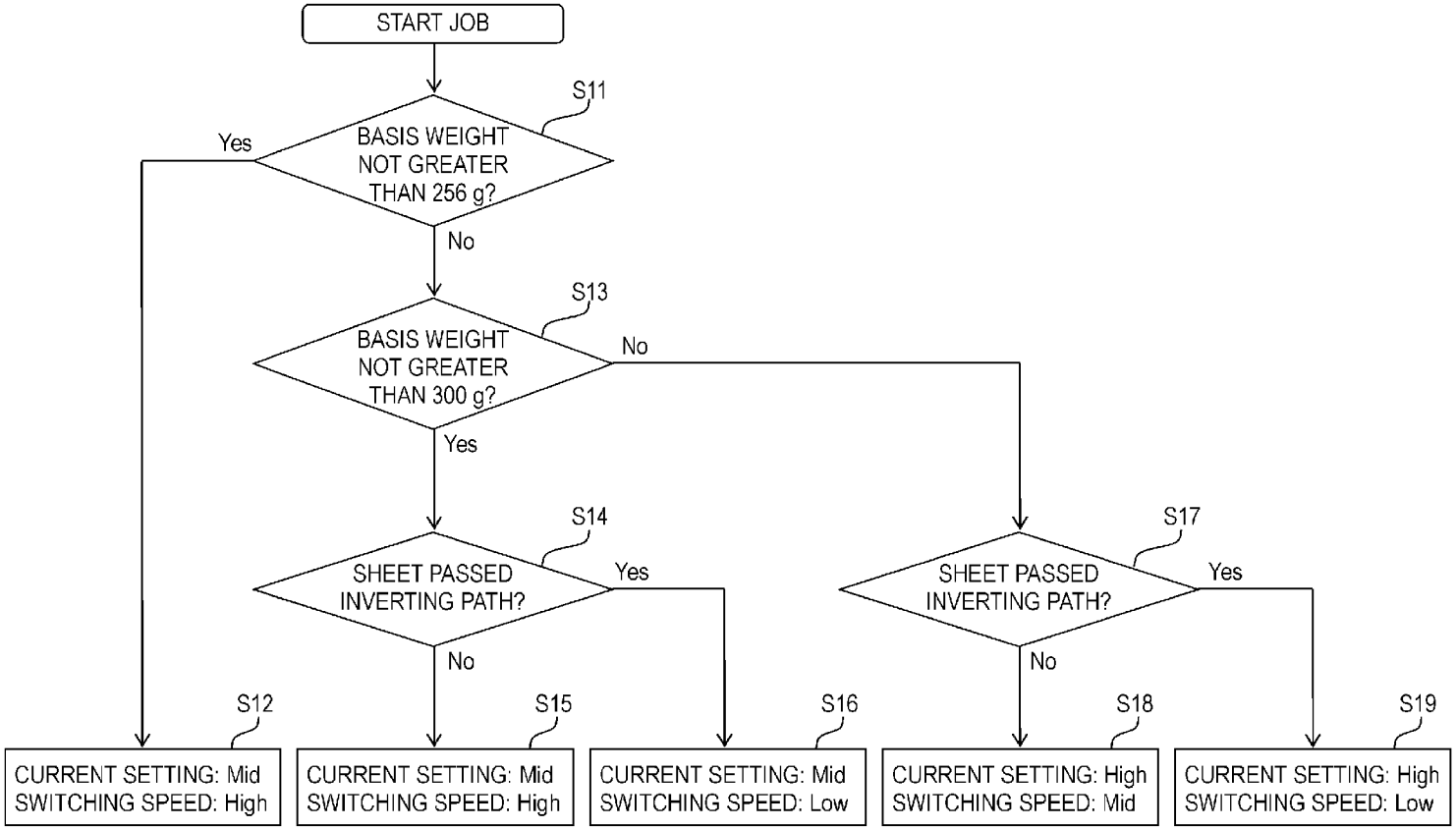
FIG. 9 is a flowchart showing the flow of control of the driver that drives the guide member.

There now follows a description of the flow of operation, with reference to FIG. 9 and FIG. 10, of changing the settings of the operation speed V and current I of the drive motor M1 for driving the guide member 81 in accordance with the basis weight of the sheet. FIG. 9 is a flowchart of the operation for changing the settings of the operation speed V and current I of the drive motor M1 for driving the guide member 81 in accordance with the basis weight of the sheet. FIG. 10 is a table showing the torque margin and crash margin when the drive motor is operated based on the flowchart of FIG. 9.

Here, torque margin is an extra amount of torque with which no stalling of the drive motor M1 for driving the guide member 81 occurs. Crash margin is an amount of time available, after the guiding position of the guide member 81 has been switched, for the tip of the sheet to reach the guide member 81.

In the following description, plain paper, thick paper having a larger basis weight than plain paper, and very thick paper having a larger basis weight than thick paper are illustrated as examples of sheets having different basis weights. The controller C has a first threshold (here, 256 gsm) and a second threshold greater than the first threshold (here, 300 gsm) stored therein beforehand as preset values used for comparison with a set basis weight of a sheet.

When a job is started and the controller C determines that the set basis weight of the sheet P is not greater than 256 gsm at step S11, the process goes to step S12. Since a sheet P with a basis weight of not greater than 256 gsm is classified as plain paper, the drive motor M1 is driven with the current setting at Mid (e.g., 0.5 A) and the switching speed at High (e.g., 5 rps) at step S12 to operate the guide member 81.

If the set basis weight of the sheet P is determined to be greater than 256 gsm at step S11, the process goes to step S13. If the set basis weight of the sheet P is determined to be 300 gsm or less at step S13, the process goes to step S14. Here, a sheet P having a basis weight that is greater than 256 gsm and not exceeding 300 gsm is classified as thick paper. When the sheet P has not passed through the inverting path 83 at step S14, it means that the thick paper that is the sheet P has not reached the guide member 81 yet. In this case, as with plain paper, the drive motor M1 is driven with the current setting at Mid (e.g., 0.5 A) and the switching speed at High (e.g., 5 rps) at step S15 to operate the guide member 81.

When the sheet P has passed through the inverting path 83 at step S14, it means that the thick paper that is the sheet P has reached the guide member 81. In this case, the drive motor M1 is driven with the current setting at Mid (e.g., 0.5 A) and the switching speed at Low (e.g., 2.5 rps) at step S16 to operate the guide member 81. Namely, the switching speed of the guide member 81 rotated by the drive motor M1 is reduced so as to increase the torque for driving the guide member 81 when a set basis weight of a sheet is greater than the first threshold.

If the set basis weight of the sheet P is determined to be greater than 300 gsm at step S13, the process goes to step S17. Here, the sheet P having a basis weight that is greater than 300 gsm is classified as very thick paper. When the sheet P has not passed through the inverting path 83 at step S17, it means that the very thick paper that is the sheet P has not reached the guide member 81 yet. In this case, the drive motor M1 is driven with the current setting at High (e.g., 0.7 A) and the switching speed at Mid (e.g., 3 rps) at step S18 to operate the guide member 81.

When the sheet P has passed through the inverting path 83 at step S17, it means that the very thick paper that is the sheet P has reached the guide member 81. In this case, the drive motor M1 is driven with the current setting at High (e.g., 0.7 A) and the switching speed at Low (e.g., 2.5 rps) at step S19 to operate the guide member 81. Namely, the switching speed of the guide member 81 rotated by the drive motor M1 is reduced, and the current setting for the drive motor M1 is increased, so as to increase the torque for driving the guide member 81 when a set basis weight of a sheet is greater than the second threshold.

By thus changing the rotation speed (switching speed) and current settings of the drive motor M1 for driving the guide member 81 when plain paper, thick paper, or very thick paper is being passed, the guide member 81 can be operated stably.

As described above, by changing the speed and current settings of the drive motor M1 in accordance with the set basis weight of the sheet P, a required torque for driving the guide member 81 is made available. Therefore, the range of basis weights that can be dealt with can be extended only by a change in the control without alterations to hardware of the image forming apparatus. Since duplex printing of sheets with a large basis weight such as very thick paper is made possible, the user can create products with greater productivity. This way, the productivity per unit time of sheets with a large basis weight can be improved at low cost.

Embodiment 2

In Embodiment 1, the speed and current settings of the drive motor for driving the guide member 81 are changed in accordance with the basis weight of the sheet selected by the user. In comparison to this, in this embodiment, as shown in FIG. 11, the speed and current settings of the drive motor for driving the guide member 81 are changed in accordance with not only the basis weight of the sheet but also a mode that prioritizes either image quality or productivity as selected by the user.

The operation portion U shown in FIG. 3 allows for setting of a mode that prioritizes either image quality or productivity. The controller C changes the rotation speed (switching speed) of the guide member 81 rotated by the drive motor M1 or the current to the drive motor M1 so as to change the torque for driving the guide member 81 in accordance with the set basis weight of the sheet and the priority mode.

Referring to FIG. 11, the distance ΔL between sheets when the sheet is thick paper or very thick paper is wider in image quality priority mode than in productivity priority mode. Mid and Short of the inter-sheet space ΔL in productivity priority mode shown in FIG. 11 are 15 mm and 10 mm, respectively, for example. On the other hand, Mid and Short of the inter-sheet space ΔL in image quality priority mode shown in FIG. 11 are 25 mm and 15 mm, respectively, for example, i.e., the distance ΔL between sheets when the sheet is thick paper or very thick paper is wider in image quality priority mode than in productivity priority mode. In image quality priority mode, therefore, the switching speed of the guide member 81 is changed from Low (e.g., 2.5 rps) to Mid (e.g., 3 rps), so that required torque margin and crash margin are made available without an excess of torque.

This way, even when the inter-sheet space is made narrower in productivity priority mode as compared to the image quality priority mode, the torque for driving the guide member is changed in accordance with this priority mode, so that the guide member can be driven stably. In the image quality priority mode where the inter-sheet space is widened as compared to the productivity priority mode, the torque for driving the guide member is changed in accordance with this priority, so that the guide member can be driven stably without motor stalls.

As described above, the productivity per unit time of sheets having a large basis weight can be increased by making changes to the speed and current settings of the drive motor without altering hardware of the image forming apparatus.

Other Embodiments

While a drive motor is employed as the actuator (driver) that drives the guide member 81 in the embodiments described above, the actuator is not limited to this and may be a solenoid, for example. For a configuration in which a spring-biased guide member is driven with a solenoid, the force (torque) and speed of driving the guide member in the up and down direction may be controlled by changing the current for driving the solenoid and the rise/fall time of current for pulling the solenoid using PWM.

While the rotation speed of the guide member rotated by the driver is reduced, or the current to the driver is increased, so as to increase the torque for driving the guide member when a set basis weight of a sheet is greater than a predetermined value in the embodiments described above, the control is not limited to this.

For example, the controller may respond only by reducing the rotation speed of the guide member rotated by the driver so as to increase the torque for driving the guide member when a set basis weight of a sheet is greater than a predetermined value. Alternatively, the controller may respond only by increasing the current to the driver so as to increase the torque for driving the guide member when a set basis weight of a sheet is greater than a predetermined value. This configuration provides the effects similar to those of the previously described embodiments.

Although a printer was illustrated as the image forming apparatus in the embodiments described above, the present invention is not limited to this. For example, the image forming apparatus may be other machines such as a copying machine and facsimile machine, or may be other machines such as a multi-functional machine having a combination of these functions. While the illustrated image forming apparatus is of the type that uses an intermediate transfer member so that toner images of respective colors are transferred on the intermediate transfer member in a sequentially superimposed manner and the toner images carried on the intermediate transfer member are collectively transferred to a sheet, the image forming apparatus is not limited to this. The image forming apparatus may be of the type that uses a sheet carrier and transfers toner images of respective colors in a sequentially superimposed manner to a sheet carried on the sheet carrier. Similar effects can be achieved by applying the present invention to these image forming apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-026455, filed Feb. 18, 2019, which is hereby incorporated by reference herein in its entirety.

What is claimed is:

1. An image forming apparatus comprising:

a first conveying member that nips and conveys a sheet on which an image has been formed;

a guide member rotatable between a first guiding position where the guide member guides a sheet that is conveyed by the first conveying member toward a first direction and a second guiding position where the guide member guides the sheet toward a second direction that is different from the first direction;

a second conveying member that conveys a sheet that has been guided toward the first direction by the guide member;

a third conveying member that conveys a sheet that has been guided toward the second direction by the guide member;

a driver that drives the guide member so that the guide member rotates;

an acquiring portion configured to acquire a basis weight of a sheet; and a controller that controls the driver such as to change torque for rotating the guide member based on a basis weight of a sheet acquired by the acquiring portion.

2. The image forming apparatus according to claim 1, wherein the controller changes a rotation speed of the guide member rotated by the driver such as to change torque for driving the guide member based on a basis weight of a sheet acquired by the acquiring portion.

3. The image forming apparatus according to claim 1, wherein the controller changes a current to the driver such as to change torque for rotating the guide member based on a basis weight of a sheet acquired by the acquiring portion.

4. The image forming apparatus according to claim 1, wherein the controller reduces a rotation speed of the guide member rotated by the driver, or increases a current to the driver, such as to increase torque for driving the guide member when a basis weight of a sheet acquired by the acquiring portion is greater than a predetermined value.

5. The image forming apparatus according to claim 1, wherein the controller reduces a rotation speed of the guide member rotated by the driver such as to increase torque for driving the guide member when a basis weight of a sheet acquired by the acquiring portion is greater than a predetermined value.

6. The image forming apparatus according to claim 1, wherein the controller increases a current to the driver such as to increase torque for rotating the guide member when a basis weight of a sheet acquired by the acquiring portion is greater than a predetermined value.

7. The image forming apparatus according to claim 1, wherein the acquiring portion is configured to allow for setting of a basis weight of a sheet and to allow for setting of a mode that gives priority to image quality or productivity, and wherein the controller changes a rotation speed of the guide member rotated by the driver or a current to the driver such as to change torque for driving the guide member based on a set basis weight of a sheet and a priority mode.

8. The image forming apparatus according to claim 1, wherein when sheets successively conveyed by the first conveying member are guided alternately to the first direction and to the second direction by the guide member, the controller causes the guide member to rotate with a torque corresponding to a basis weight of a sheet acquired by the acquiring portion before a preceding sheet conveyed by the first conveying member passes through the guide member and before a succeeding sheet that is conveyed after the preceding sheet reaches the guide member.

9. The image forming apparatus according to claim 1, wherein the controller changes torque for rotating the guide member being contacted to the conveyed sheet, based on a basis weight of a sheet acquired by the acquiring portion.

10. The image forming apparatus according to claim 1, wherein when guiding a sheet to the second conveying member, the controller causes the guide member to be at the first guiding position, and controls the driver such as to rotate the guide member to a third guiding position where an upstream end of the guide member comes close to a tangential line at a nip portion of the first conveying member, after a tip of the sheet being conveyed by the first conveying member has reached the guide member, and wherein when guiding a sheet to the third conveying member, the controller causes the guide member to be at the second guiding position, and controls the driver such as to rotate the guide member to a fourth guiding position where an upstream end of the guide member comes close to a tangential line at a nip portion of the first conveying member, after a tip of the sheet being conveyed by the first conveying member has reached the guide member.

11. An image forming apparatus comprising:

a first conveying member that conveys a sheet on which an image is formed;

a guide member rotatable between a first guiding position where the guide member guides a sheet that is conveyed by the first conveying member toward a first direction and a second guiding position where the guide member guides the sheet toward a second direction that is different from the first direction;

a second conveying member that conveys a sheet that has been guided toward the first direction by the guide member;

a third conveying member that conveys a sheet that has been guided toward the second direction by the guide member;

a driver that drives the guide member so that the guide member rotates;

an acquiring portion configured to acquire a basis weight of a sheet; and a controller configured to control the driver so as to change a rotation speed of the guide member which contacts the sheet, based on the basis weight acquired by the acquiring portion.

12. The image forming apparatus according to claim 11, wherein when the basis weight of the sheet which the acquiring portion acquired is a first basis weight, the controller sets the rotation speed of the guide member slower than a case when the basis weight of the sheet which the acquiring portion acquired is a second basis weight which is smaller than the first basis weight.

13. An image forming apparatus comprising:

a first conveying member that conveys a sheet on which an image is formed;

a guide member rotatable between a first guiding position where the guide member guides a sheet that is conveyed by the first conveying member toward a first direction and a second guiding position where the guide member guides the sheet toward a second direction that is different from the first direction;

a second conveying member that conveys a sheet that has been guided toward the first direction by the guide member;

a third conveying member that conveys a sheet that has been guided toward the second direction by the guide member;

a driver that drives the guide member so that the guide member rotates;

an acquiring portion configured to acquire a basis weight of a sheet; and a controller configured to change a current flowing to the driver when the driver rotates the guide member which contacts the conveyed sheet, based on the basis weight acquired by the acquiring portion.

14. The image forming apparatus according to claim 13, wherein when the basis weight of the sheet which the acquiring portion acquired is a first basis weight, the controller controls so to set the current flown to the driver larger than a case when the basis weight of the sheet which the acquiring portion acquired is a second basis weight which is smaller than the first basis weight.

15. The image forming apparatus according to claim 1, wherein the driver comprises a motor.

16. The image forming apparatus according to claim 11, wherein the driver comprises a motor.

17. The image forming apparatus according to claim 13, wherein the driver comprises a motor.

* * * * *